United States Patent [19]

Jamieson

[11] 4,108,100

[45] Aug. 22, 1978

[54] RIGGING BASE FOR PLURAL-HULL SAILING CRAFT AND METHODS FOR SAIL CONTROL

[76] Inventor: Robert Stuart Jamieson, 3705 Stephen M. White Dr., San Pedro, Calif. 90731

[21] Appl. No.: 804,875

[22] Filed: Jun. 9, 1977

[51] Int. Cl.[2] ..... B63H 9/04

[52] U.S. Cl. ..... 114/102; 114/39; 114/61

[58] Field of Search ..... 114/39, 43, 89, 90, 114/92, 93, 94, 95, 96, 97, 98, 99, 100, 102, 103, 111, 112, 113, 61

[56] References Cited

U.S. PATENT DOCUMENTS

| | | | |
|---|---|---|---|
| 1,856,803 | 5/1932 | Blackman | 114/102 |
| 2,351,542 | 6/1944 | Paull | 114/39 |
| 3,316,873 | 5/1967 | Dismukes | 114/61 |
| 3,839,979 | 10/1974 | Wassell | 114/39 |
| 3,841,251 | 10/1974 | Larson | 114/39 |
| 3,933,110 | 1/1976 | Jamieson | 114/39 |

*Primary Examiner*—Trygve M. Blix
*Assistant Examiner*—D. W. Keen

[57] ABSTRACT

An elongated spar is attached longitudinally to cross-members interconnecting the hulls of plural-hull sailing craft, which spar projects forward to provide points of attachment for the forestays and headsail tacks of the sailing craft, whereby the forces exerted by the forestays and headsail tacks are removed from the bows of the hulls of the sailing craft and employed to oppose mast downthrust forces, substantially reducing the load on the hull-interconnecting structure. If applied to existing sailing craft the danger of hull breakage is eliminated and danger of hull-interconnecting structure failure is greatly reduced. The forward projection of the spar may be fabricated to cause a controllable lateral deflection of the luff of the headsail, to vary the airflow through the slot between the headsail and a mainsail. Similarly, an aftward projection may be employed to control mainsail sheeting angle and to make the mainsail self-tending when the sailing craft tacks. For sailing craft which reverse the direction of travel identical projections are provided at both ends of the spar. For sailing craft undergong a mirror-image transformation in spatial relationship of the hulls the spar is pivotally mounted such that the sails also undergo a mirror-image transformation simultaneously.

14 Claims, 9 Drawing Figures

RIGGING BASE FOR PLURAL-HULL SAILING CRAFT AND METHODS FOR SAIL CONTROL

BACKGROUND OF THE INVENTION a. Field of the Invention

The invention relates to the field of the rigging of plural-hull sailing craft, and particularly concerns an arrangement for removing rigging forces from the hulls, and for reducing the downthrust of the mast upon the hull-interconnecting structure.

b. Description of Prior Art

Of all the various types of plural-hull sailing craft only the trimaran possesses a conventional mounting base for forestays and headsail tacks, on the foredeck of the centrally-located main hull. In catamarans, proas, and other types of plural-hull sailing craft such as that described in my U.S. Pat. No. 3,933,110 and my copending application Ser. No. 825,441, the headsail tack is located in air over water, as is the lower end of the forestay. This presents a difficulty in securely attaching the forestay and headsail tacks to the sailing craft. In the past this was usually overcome by attaching twin cables to the bows of the leading hulls; the free ends of these cables were connected to each other and to the forestay, and the headsail tack was connected either to the junction of the cables or to the forestay in the vicinity of the junction — an arrangement usually called a bridle. This arrangement was simple and light, and seemed to add very little weight to the craft, when compared to comparable craft without headsails. However, the small bridle weight is deceptive, for by reason of its geometry the stress it places on the bows is so high as to tend to break the hulls off at the forward hull-interconnections. This requires that the hulls be heavy enough to withstand these substantial forces. A typical bridle places an upward pull on each bow of half the vertical component of combined headsail-forestay pull on the bridle: it places a horizontal inward pull on each bow whose magnitude depends on the angle between the legs of the bridle. The greater that angle the greater the inward pull. There is a tendency to keep the headsail low, to reduce the heeling forces on the craft, which causes a greater angle, resulting in a magnification of the vertical force component on the bridle. It is not unusual for these horizontal components to have a magnitude of over twice the vertical components on the bows. Normally the hulls are narrow and deep, thereby having a higher strength in the vertical, yet must resist greater horizontal forces. These forces are exerted at distances over four feet, in light one-man daysailers, to over twelve feet in larger racing craft. Consequently the hulls must withstand breaking moments of from hundreds to thousands of foot-pounds. Since these hulls are normally not fabricated of materials having high ratios of strength-to-weight, the resulting increase in hull weight is often appreciable.

In certain cases a compression member is connected from bow to bow to resist the inward pull. Usually a long, slender, sometimes streamlined, aluminum tube, this compression member's actual ability to resist the inward hull-breaking force is far less than the compressive strength of the tube. The ratio of length of the tube to its radius of gyration is so high that the tube is actually operating in the regime of very long columns, whose drastically-reduced resistance to buckling loads is well known. In addition, wave slap, bouncing and vibration, and the pull of gravity, cause this member to deflect from a straight line, such that it then acts more like a spring than a column. Thus the tube cannot totally remove the extra hull weight, but is usually employed as a secondary means of resistance. In some cases this tube is only remedial, being applied after design, to craft which have exhibited a tendency to hull failure. Tubes large enough in diameter to act as compression members would increase the wind resistance of the sailing craft, would approach the size of the hull-interconnecting structure and hence be considered unsightly and cumbersome by some, so most manufacturers place the needed strength where it is not so apparent to the eye.

In many old-fashioned monohull sailing craft the presence of a bowsprit and/or a jibboom provided a mounting base for stays and tacks which would otherwise be located in midair over water. These spars were securely housed in the bows of the craft; most plural-hull sailing craft have not been able to adopt this approach for they lack bows in the proper location.

Accordingly, it is an object of this invention to remove the forces exerted by forestays and headsail tacks from the hulls of plural-hull sailing craft, and to eliminate the danger of hull breakage resulting from such forces. It is another object of this invention to reduce the weight of the hulls of plural-hull sailing craft.

In plural-hull sailing craft the mainsail sheet also exerts an upward pull; usually this is resisted chiefly by the rearmost hull-interconnecting cross-member. This pull is transmitted to the hulls and the foremost cross-member; the hulls being enabled to resist this force since the ends of the cross-members are usually rigidly attached to substantial side beams, which act in concert with the hulls; the side beams being usually fabricated of a material having a high ratio of strength-to-weight. However, the side beams are thus heavier than required by their primary task of supporting the deck trampoline and crew.

Accordingly, it is another object of this invention to reduce the forces exerted upon the side beams by the pull of the mainsail sheet, and thereby to reduce the weight of the side beams of plural-hull sailing craft.

The sheet force has a counterpart in the downward pull that the head of the mainsail exerts upon the upper region of the mast. In the same manner, the forestay, the headsail, the shrouds, the backstay (if present), and the weight of the sails and rigging, also exerts a downward pull of the upper region of the mast. The sum of these forces represents the compression loading on the mast, which together with the weight of the mast, exert a substantial downthrust force upon the mast step and that portion of hull-interconnecting structure which carries the mast step - usually the foremost cross-member, called the main beam. This downthrust is the greatest concentration of forces exerted anywhere in the craft. The downthrust is so severe, especially in high winds, that it is not unknown for fast, lightweight racing craft to suffer a bending failure of the main beam under the mast step. Often a compression member (called a dolphin-striker) is attached below the main beam under the mast seat to transfer much of the downthrust to lateral tension members connected also to the outer ends of the main beam. In short, the main beam is made into a truss.

Accordingly, it is another object of this invention to reduce the forces exerted upon the main beam by mast downthrust, and thereby reduce the weight of the main beam truss.

Certain plural-hull sailing craft, notably the proa or calie, reverse the direction of travel when tacking through the wind, in order to keep the shorter hull to windward. These must usually move rudders, stays, and sails to opposite ends of the craft to complete the maneuver.

Accordingly, it is another object of this invention to provide a base for the rigging of reversing plural-hull sailing craft, which base has reversibility.

In the plural-hull sailing craft of my U.S. Pat. No. 3,933,110 and my co-pending application Ser. No. 825,441, the configuration of the relationship of the hulls undergoes a mirror-image transformation when the craft tacks or gybes. Consequently the locations of the headsail tack and the forestay end and of the mainsail sheet trim point must also undergo a mirror-image transformation. Since the hulls are pivotally connected to the hull-interconnecting structures (called spyders) this causes extra difficulties in the use of bridles, in addition to the geometric constraints imposed by the requirements of mirror-image transformation.

Accordingly, it is another object of the invention to provide a mounting base for rigging of plural-hull sailing craft whose hulls and sails undergo a mirror-image transformation while tacking or gybing.

With a fixed location for the headsail tack the only control for the volume and velocity of air flowing through the space between an overlapping headsail and a mainsail (called the slot) is by changing the tension of the headsail sheet, to change slightly the amount of convergence of the cross-sectional airfoil shape of the two sails, or to move the headsail sheet trim point laterally to change the width of the slot exit, thus not appreciably affecting the shape of either airfoil but appreciably changing the amount of convergence of the two airfoils. If the trim point is moved inwards too much, in an attempt to increase airflow velocity in the slot, the convergence will be too great, causing the air to impinge too directly on the lee side of the mainsail, instead of flowing along the lee side of the mainsail. This will cause the mainsail to be backwinded; and it will bulge appreciably to windward, spoiling the slot's enhancement of sail efficiency. If the trim point is moved out too far the airfoil curves will not converge, or even may diverge; airflow velocity is reduced and sail efficiency declines.

Accordingly, it is another object of the invention to provide better control of the volume of air intercepted by the headsails of plural-hull sailing craft, thereby providing additional control of slot airflow velocity and sail efficiency.

In certain monohull racing boats the headsail tack attachment point may be moved fore-and-aft to obtain a better balance with the forces of lateral resistance in the water, to make steering of the craft easier and more sensitive. Sail trimming and fine tuning of the rig can also be affected, giving the operators of the craft another controllable variable. This feature is not available with bridles. While conceivably the junction of the bridle cable could be hauled back and forth slightly, this would tend to increase the forestay tension drastically, for a very small range of movement.

Accordingly, it is another object of the invention to provide longitudinally variable position of headsail tack attachment, for better sail trim, rig tuning, and balance for steering.

Similarly, it would also be desireable to move the position of the mainsail sheet trim point fore-and-aft, and to eliminate the boom. Since most plural-hull sailing craft have no physical base for attaching the main sheet trim point as far aft as directly under the mainsail clew, a boom must be used, with the sheet blocks attached centrally, in the vicinity of the aft beam. If mounting were provided below and after the main clew for the mainsail sheet trim point, the moveable positioning mechanism would serve to outhaul a mainsail without a boom, for shape control. If also the aftward extending mounting base for the mainsail sheet trim point could be controllably deflected laterally, the mainsail sheeting angle could also be varied.

Accordingly, it is another object of the invention to provide a mounting base for a boomless mainsail's sheet. It is another object to provide longitudinal adjustment for the mainsail sheet trim point. It is yet another object of the invention to provide mainsail sheeting angle control for boomless mainsails in plural-hull sailing craft.

It would be another desireable feature in a plural-hull sailing craft to make the mainsail sheet to be self-tending when the craft tacks, such that the mainsail sheet trim point is carried over to an equivalent position on the other tack.

Accordingly, it is another object of the invention to provide a self-tending capability for mainsail sheets in plural-hull sailing craft.

SUMMARY OF THE INVENTION

In carrying out the priciples of my invention, according to a preferred embodiment, an elongated spar is mounted longitudinally on a plurality of hull-interconnecting cross-members, at their centers: the spar being mechanically connected to the mast step, and providing points of attachment for forestays and headsail tacks. Means are provided to control the lateral deflection of the forward projecting arm of the spar so as to vary the incident airflow directed past the mainsail's lee side by the headsail. A reaction force, caused by the upward pull of the headsail tack and/or the forestay, is exerted by the spar against the mast step, reducing the mast downthrust which must be resisted by the hull-interconnecting structures. Since the forestay and headsail tack forces are eliminated from the bows, and hulls can be fabricated to be light in weight. The spar also resists a portion of mainsheet upward force, further reducing the forces which must be resisted by the hull-interconnecting structures of plural-hull sailing craft. More specifically, in one preferred embodiment for plural-hull sailing craft having fixed hull spatial relationship, such as catamarans, proas and calies, etc., the spar is mounted on the lateral structural cross-beams at their centers; the spar projects forward of the mast foot and the main cross-beam to provide points of attachment for forestays and headsail tacks, means are provided to transmit a portion of mast downthrust to the spar, control means are provided to control lateral deflection of the forward-projecting arm of the spar for varying the volume airflow intercepted by the headsail and directed along the lee side of the mainsail; other control means are provided to move the location of the headsail tack along the spar for steering balance adjustments and fine tuning of the sail rig.

In a first variation of the preferred embodiment, an aft arm is connected to the aft end of the backbone spar by a hinge which allows rotation of the arm in the horizontal. The arm carries a track for moving the position of the main sheet trim point in and out, to control mainsail shape; outhaul control means are shown. Control means are provided to control the lateral deflection of the aft arm so that mainsail sheeting angle may be varied, and so that the main sheet may be self-tending.

In a second variation of the preferred embodiment, arms are provided at both ends of the backbone spar for plural-hull sailing craft which reverse their direction of travel, such as the proa. Two sets of attachment points are provided so that the sails may also be reversed when the craft tacks.

In a third variation of the preferred embodiment, for plural-hull sailing craft whose hulls are in pivoting relationship with their interconnecting structure and which undergo a mirror-image transformation of the spatial relation of the hulls, the backbone spar is pivotally mounted on the central hubs of the two hull-interconnecting spyders, such that the backbone spar remains parallel to the hulls at all times and and the sails also undergo a mirror-image transformation as the craft tacks. Control means are provided to move the location of the main sheet trim point along the aft leg of the aft spyder, such that the mainsail may be controlled without a boom, and so that the mainsail sheeting angle will also undergo a mirror-image transformation as the craft tacks.

DESCRIPTION OF A PREFERRED EMBODIMENT

General Description

Figure 1:
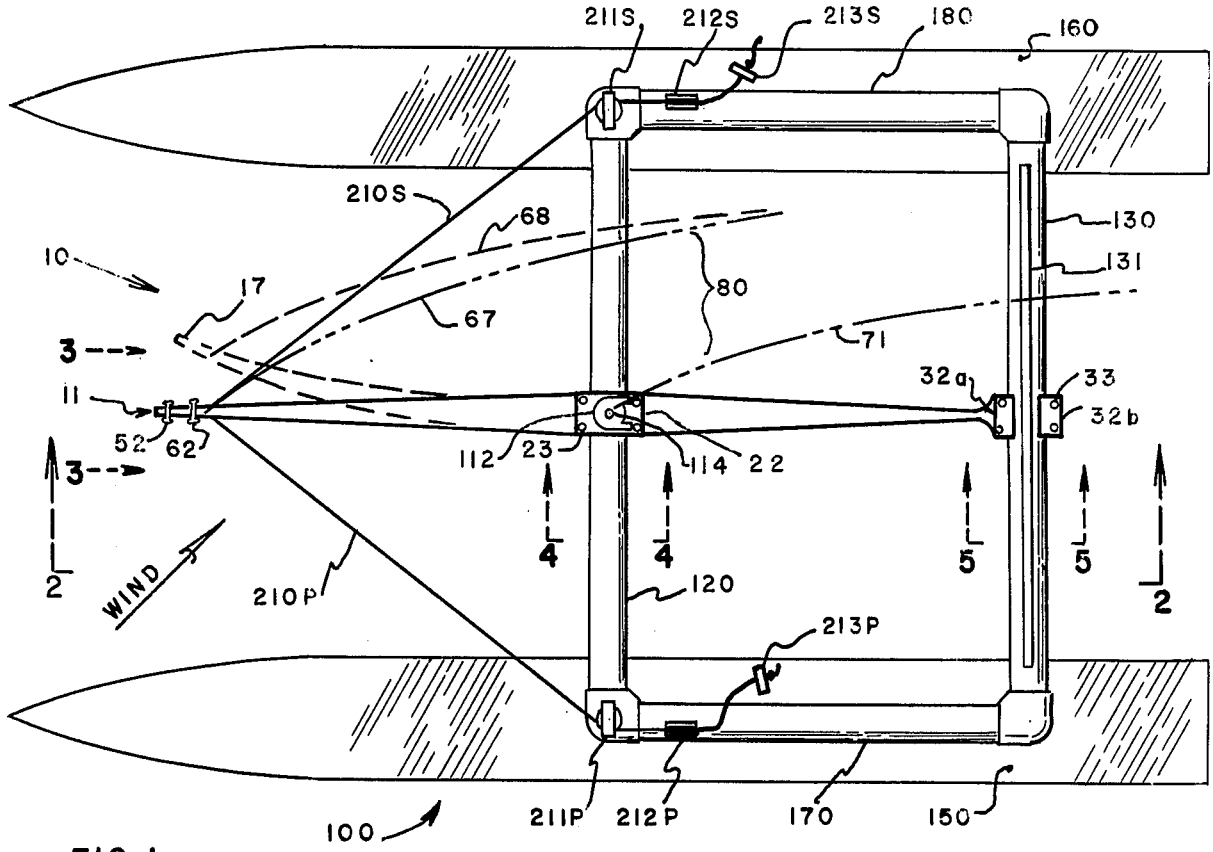
FIG. 1 is a top plan view of the preferred embodiment mounted on a catamaran.

A preferred embodiment, illustrated in FIGS. 1 through 5, and generally indicated therein by 10, comprises an elongated longitudinal spar, called herein the backbone spar 11, adapted for mounting on a conventional catamaran 100, and further adapted for providing a mounting base for forestay 50 and jib tack 61. The upward tensional forces exerted upon projecting forearm 18 of backbone 11 by forestay 50 and jib tack 61, acting through conventional attachment means well known to those skilled in the art, are transmitted to mast step 110 by main mounting means 20, and also transmitted to aft beam 130 through aft mounting means 30. Forearm 18 acts as a cantilevered beam having different vertical and lateral stiffnesses; beam 19 of backbone 11 acts as a simple beam with two supported ends, also having different vertical and lateral stiffnesses. Similarly, a substantial portion of the upward force exerted upon aft beam 130 by the tension of the sheet (not shown) of mainsail 70 is transmitted to backbone spar 11 through aft mounting means 30, and thence to mast step 110, and to forestay 50 and jib tack 61. Thus backbone spar 11 provides a mounting base for forestay 50 and jib tack 61 independant of any hull or bouyant structure of catamaran 100. Further, that component of mast 140 downthrust force caused by the downward pull of forestay 50 and jib 60 acting upon the upper region of mast 140 is transmitted directly to backbone spar 11 through main mounting means 20; this downthrust component is opposed by a reaction force exerted by backbone spar 11 upon main mounting means 20, said reaction force being caused by the upward pull of forestay 50 and jib tack 61. Similarly, a reaction force caused by that portion of main sheet tension transmitted to backbone 11 opposes that component of mast downthrust caused by the downward pull of mainsail 70 upon the upper region of mast 140. Thus, these two components of mast 140 downthrust are not exerted upon main beam 120; in contradistinction to prior art in which the main beam must withstand total mast downthrust, by far the greatest force acting upon any portion of conventional plural-hull sailing craft. The only components of mast downthrust which main beam 120 must resist, when the principles of my invention are employed, are those caused by: leeward shroud tension (usually zero), windward shroud tension, the weight of mast 140 and all rigging and sails aloft, and that portion of downward pull on the upper regions of mast 140 caused by mainsail 70 not transmitted to backbone spar 11, and by any backstays which might be present. That component caused by main sheet pull which is not transmitted to backbone spar 11 must be resisted by main beam 120, along with hulls 150 and 160, side beams 170 and 180, and aft beam 130.

When sailing closehauled sheet forces and mast downthrust are at a maximum, and the main sheet trim point most closely approaches the centerline of the craft. In other words, the main sheeting angle approaches zero, and main sheet forces are exerted on aft beam 130 closer to its junction with aft mounting means 30, transmitting a larger portion of main sheet force to backbone spar 11. This causes a larger reaction force to be exerted against mast step 110 by backbone 11, thus opposing a larger portion of mast downthrust, when most needed. This significantly reduces the strength requirements of all hull-interconnecting structures of catamaran 100, enabling significant reductions in weight of those structures. In addition, removal of forestay and jib tack forces from the bows of the hulls of plural-hull sailing craft enables a further significant reduction in the weight of said hulls. The following numerical example, taken from actual force measurements, will serve to illustrate:

The jib tack downhaul line of a jib having an area of 65 square feet exerted a vertical component on a prototype backbone of 485 pounds, acting on a moment-arm of five feet. Because of the high jib tension the forestay was slack. Since the beam portion of the backbone was 5.75 feet long, the reaction force exerted against the aft beam is seen to be 421.7 pounds acting downwards. The reaction force exerted upwards against the mast step is calculated as 906.7 pounds. The mains sail had an area of 170 square feet, its sheet had a vertical pull of 375 pounds. The lee shroud was slack; the weather shroud had a vertical component of tension of 510 pounds. The total weight aloft was 110 pounds. Summing the vertical forces yields a total mast downthrust of 1478 pounds. Without the backbone, this would be exerted upon the main beam alone. Since the backbone removes 906.7 pounds, the main beam need only withstand 571.3 pounds; a reduction to 39% of total mast downthrust. Further, the sheet force is not resisted entirely by the aft beam; the backbone will exert up to 421.7 pounds in a downward direction to oppose the upward sheet pull. Even at large sheeting angles, the backbone will assist the aft beam significantly, the exact value of assistance depending upon sheeting angle, relative stiffness of the backbone and the aft beam, and so on.

The total backbone weight was 16.8 pounds. Since it replaces a cable bridle weighing 2.6 pounds, and main beam truss elements weighing 4.7 pounds, the net increase in weight caused by adding the backbone to an existing design was 9.5 pounds. Although adding the principles and apparatus of my invention to an existing design would add a small weight penalty, it would greatly reduce the danger of main beam failure, and eliminate danger of hull failure caused by jib and forestay forces.

After some testing, the side beams, having a weight of 1.3 pounds per foot, were replaced by circular tubes weighing 0.51 pounds per foot. This saved 8.7 pounds, reducing the net increase from addition of the backbone to only 0.8 pounds. During subsequent testing there were no structural failures.

The fiberglass-resin hulls of the craft weighed 140 pound total, and had been designed and fabricated to withstand jib-forestay bridle forces pulling the bows towards each other at a magnitude of at least 1.1 times the vertical component of jib-forestay pull; a force of 533.5 pounds acting laterally on each bow. The moment-arm to the bows, from the forward supports, was six feet, causing lateral moments of 3200 foot-pounds. If these lateral moments had been eliminated by applying the principles of my invention to the design before fabrication, and employing the apparatus of my invention during fabrication, the total weight of the hulls could have been reduced over 10 percent with ease. The total weight of the entire craft would have been reduced by at least 13.2 pounds. Since the remaining loads on the hulls (weight loads, bouyant forces, drag, lateral resistance) exert much smaller moments than does the bridle, a 10 percent hull weight reduction is quite conservative an estimate.

DESCRIPTION OF SPECIFIC ELEMENTS a. The Backbone Spar

Backbone spar 11 is preferably fabricated of a material having a high ratio of strength-to-weight such as aluminum, magnesium-aluminum alloys, carbon or boron fiber composites, cold-laminated woods, or other materials suitable for use in a marine environment. As illustrated in FIGS. 1 through 5, backbone spar 11 may be fabricated from an I-beam of conventional cross-sectional shape. It is to be understood that the cross-section may be of any shape suitable for obtaining the desired bending characteristics, capable of withstanding the stresses imposed thereon, and preferably economical to purchase. Forearm 18 and beam 19 are shown as being fabricated as one integral entity; however, forearm 18 may be fabricated as a separate entity and rigidly joined to beam 19, as by bolting or riveting. FIG. 3 is a fragmentary end view of forearm 18 with one attaching means in place; the dashed outline 12 represents one possible shape for a thin streamlining cover to be attached along the length of backbone spar 11; or, alternatively, for the outline of light-weight fillers, preferably fabricated from moderately flexible plastic foam. Since the incident wind will impinge upon backbone 11 from both sides as the sailing craft sails on eigher tack, outline 12 is preferably bilaterally symmetrical.

As seen in FIGS. 1 through 5, backbone spar 11 is preferably placed with flanges 13 and 14 horizontal, so as to best resist the vertical forces, which greatly exceed the horizontal forces acting upon backbone spar 11. FIG. 1 illustrates how flanges 13 and 14 may be tapered in width from the vicinity of main mounting means 20 to a minimum width towards both ends of backbone spar 11. This will cause a significant reduction in weight without causing an appreciable increase in vertical deflection - as long as the cross-sectional area moment of inertia (taken about the horizontal center of area) does not reduce at a higher rate than the moments acting upon backbone spar 11 in the vertical plane. Since the moment at any point along the length of backbone spar 11 is directly proportional to the distance to that point from the place where a force is applied, it can be seen that the moment declines linearly to zero at the place where the force is applied. Since the jib and forestay forces are applied to backbone spar 11 near the tip of forearm 18, the moment will be zero where the width of flanges 13 and 14 is at a minimum. Even if the width of flanges 13 and 14 decline to zero at the tip of forearm 18, the area moment of inertia will be larger than zero, because of the presence of the area of web 16. Therefore, the unit stress at the tip of forearm 18 will be less than that in the vicinity of main mounting means 20, where both cross-sectional area and unit stress are greatest (at the point of maximum moment).

In the vicinity of aft mounting means 30 the stress on backbone 11 is mostly shear, and the cross-section area of web 16 could support it alone; however, upper flange 13 is widened to provide a mounting base for aft mounting means 30. Lower flange 14 is tapered to minimum width below aft mounting means 30.

The cross-sectional area moments of inertia taken about the vertical center of area decreases approximately as the cube of flange width; a much higher decline that for the decrease of lateral force moments, causing high lateral compliance (low lateral stiffness) and bending. However, the lateral forces acting upon forearm 18 are smaller than the vertical forces. Further, this lateral flexibility is a desireable feature of forearm 18, as will be shown. Beam 19 of backbone spar 11, being restrained at both ends, does not need a high value of lateral stiffness.

b. Attaching Means

Figure 2:
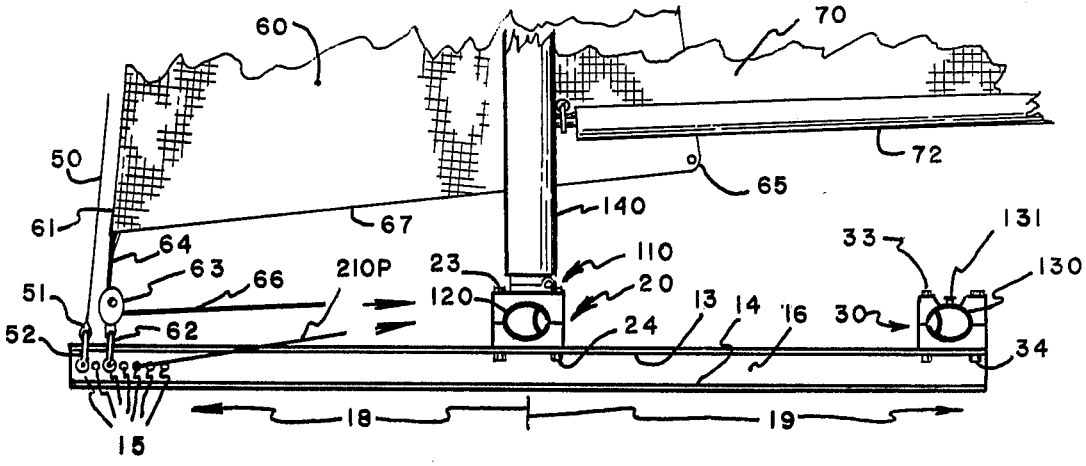
FIG. 2 is a port side elevation view of the preferred embodiment, showing the catamaran's beams in section.
Figure 3:
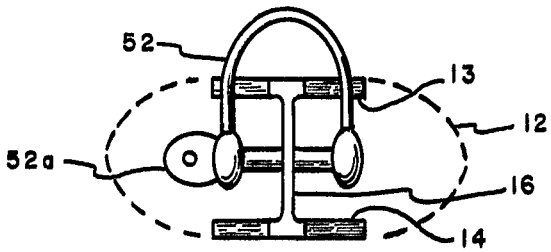
FIG. 3 is an end view of the foreward tip of the backbone spar, showing a typical rigging attachment means in place.

Referring to FIG. 2, multiple mounting locations for attachment of jib tack downhaul block 63 and forestay 50 are provided by the series of holes 15 drilled through the web 16 of forearm 18. Conventional shackle 52 is passed through eye 51 which terminates forestay 50; shacklebolt **52*a* is passed through desired hole 15 and the ends of shackle 52, thereby attaching forestay 50 to forearm 18. In like manner, shackle 62 is passed through the strap of jib tack downhaul block 63, shacklebolt 62***a* is passed through another desired hole 15 and the ends of shackle 62, thereby attaching jib tack downhaul block 63 to forearm 18. Jib tack downhaul line 64 is passed through jib tack downhaul block 63, and its pendant end 66 is led to a conventional cleating device located at a place convenient to the operators of the sailing craft (not shown, for purposes of clarity).

It is to be understood that forestay 50, eye 51, shackles 52 and 62, jib tack downhaul line 64, jib tack downhaul block 63, and pendant end 66 are all of conventional design and fabrication, and may be replaced by other conventional attaching and securing means well-known to those skilled in the art, and are described and depicted herein for purposes of illustration. Similarly, holes 15 may be of any number, or may be replaced by conventional tracks and travellers, slides, rollers, or other devices providing a positional adjustment, also well known to those skilled in the art. Preferably these will be mounted on the upper surface of flange 13.

c. Mounting Means

Figure 4:
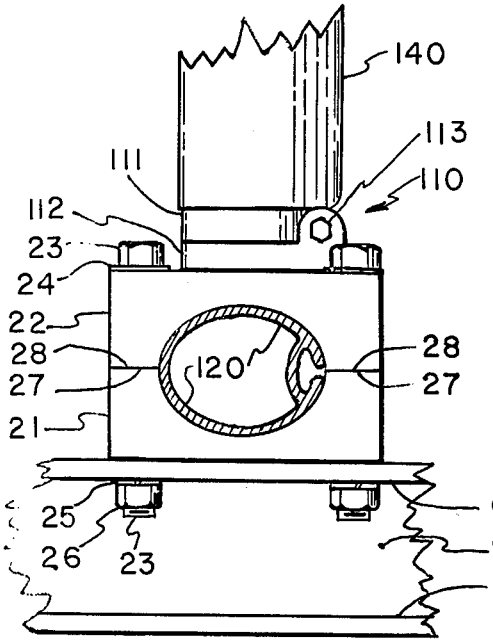
FIG. 4 is a detailed fragmentary port side elevation view of the main mounting means and the mast step.

FIG. 4 is a detailed fragmentary port side view of main mounting means 20, showing the cross-section of main beam 120. Main beam 120 is shown to be fabricated of a length of extruded aluminum tubing designed for use as a mast; a common fabrication practise in the manufacture of light, daysailing or racing multihull sailing craft. It is to be understood that main beam 120 may be fabricated of any material and in any shape suitable for the use thereof, and is described and depicted herein for exemplary purposes only. Main mounting means 20 comprises lower saddle block 21 and upper saddle block 22 which clamp main beam 120 securely between them; the clamping forces are derived from a plurality of clamp bolts 23 passing through holes drilled through upper saddle block 22 and lower saddle block 21. Clamp bolts 23 further extend through matching holes in upper flange 13 of backbone spar 11; nuts 26 are threaded on the lower ends of clamp bolts 23 and tightened to securely attach main mounting means 20 to backbone spar 11, and to clamp main beam 120 to main mounting means 20. Washers 24 increase the bearing area under the heads of clamp bolts 23; lockwashers 25 secure nuts 26 against becoming loosened during use. The inner clamping surfaces of saddle blocks 21 and 22 are shaped to closely fit main beam 120 so as to prevent relative motion high by surface friction therebetween. So that main beam 120 is not crushed nor distorted severely under the clamping pressure, saddle blocks 21 and 22 are designed so that their mating surfaces 27 and 28 are brought to bear upon each other when proper clamping pressure is attained. Variations in the vertical dimensions of saddle blocks 21 and 22 during manufacture may be compensated for by grinding down one or both mating surfaces 27 and 28 to increase clamping pressure, or by inserting thin shims between them to decrease clamping pressure; a technique well known to those skilled in the art of automobile engine repair.

When the preferred embodiment of this invention is to be applied to an existing sailing craft, the existing mast step assembly must first be removed from main beam 120 before installing mounting means 20 and backbone spar 11. This mast step assembly, or another, may then be mounted upon the upper surface of upper saddle block 22 by conventional fastening means. FIG. 4 illustrates a conventional horizontally-rotating, vertically-hinged mast step assembly 110, mounted upon upper saddle block 22. Mast step assembly 110 comprises an upper hinge half 111, which is usually a projecting boss of the mast foot and is rigidly attached to mast 140, the after end of upper hinge half 111 is adapted to receive hinge pin 113, herein depicted as a bolt; lower hinge half 112 is also adapted to receive hinge pin 113 and is rotatably mounted on the upper surface of upper saddle block 22 by shouldered screw 114 (visible in FIG. 1), and is captured in place by the head of the screw 114 while being permitted to rotate about its vertical axis such that mast 140 may present its leading edge to the incident wind for minimum drag and a smooth flow of air onto the luff of mainsail 70. The shoulder 114 acts as a radial bearing surface to resist horizontal forces on mast 140. The center of upper hinge half 111 is drilled to provide clearance for the head of screw 114. The upper surface of upper clamp block 22 acts as a thrust bearing to resist mast downthrust transmitted from mast 140 through hinge halves 111 and 112. A substantial portion of mast 140 downthrust is transmitted to backbone spar 11 through rigid saddle blocks 21 and 22, bypassing main beam 120 as heretofore illustrated in the numerical example. Hinge halves 111 and 112 together comprise a vertical hinge assembly for use in lowering and raising mast 140, when shipping or transporting and reassembling the sailing craft.

It is to be understood that the invention is not limited to any particular shape or type of mast step assembly 110, which may be replaced by any other mast stepping device suitable for the use described herein, and is depicted and described herein for purposes of illustration. Alternatively, upper saddle block 22 may be adapted for mounting other mast stepping devices, and its upper surface may be shaped in other than a flat plane; as for example: shaped convexly upward to fit the mounting surface of the existing mast step which was previously mounted upon the upper surface of main beam 120. Further alternatively, the mast stepping device may be mounted directly on upper flange 13 of backbone 11, as for example: aft of mounting means 20.

Figure 5:
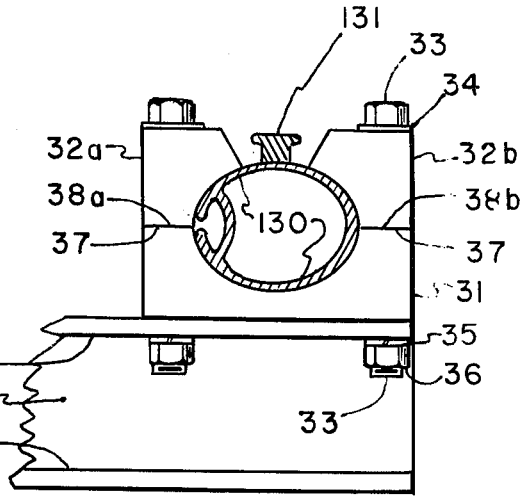
FIG. 5 is a detailed fragmentary port side elevation view of the aft mounting means and the main sheet track.

FIG. 5 is a similar view of aft mounting means 30, which is constructed in like manner to main mounting means 20, differing in that no mast is mounted upon aft beam 130 or aft mounting means 30, and in that aft beam 130 carries main sheet track 131 on its upper surface. It is to be understood that sheet track 131 may be of many different shapes other than that shown, and in certain cases is a re-entrant groove formed in the upper surface of aft beam 130 during extrusion. Sheet track 131 carries a traveller, or car, upon which the lower sheet blocks are mounted (not shown), and is usually long enough to provide a very wide range of sheeting angles, as illustrated in FIG. 1. So that sheet track 131 is not blocked at the center, thus causing difficulties when mainsail 70 is put on the other track, upper saddle block 32 is shown fabricated in two halves 32*a* and 32*b*, illustrated as being of identical shape. Otherwise, construction and design details of aft mounting means 30 are identical to those of main mounting means 20.

Briefly, upper saddle block halves 32*a* and 32*b* are clamped against aft beam 130 and mating faces 37 of lower saddle block 31, mating surface 37 abutting against mating surface 38*a* of upper saddle block half 32*a* , and mating surface 38*b* of upper saddle block half 32*b*, respectively. Discrepancies in dimensions and clamping pressures are treated as heretofore described for main mounting means 20. A plurality of clamp bolts 33, washers 34, lockwashers 35, and nuts 36, together clamp upper saddle block halves 32*a* and 32*b* against lower saddle block 31, and clamp aft beam 130 therebetween, and secure lower saddle block 31 in position on upper flange 13 of backbone 11, in the manner heretofore described for main mounting means 20. Since aft beam 130 exerts a significantly smaller force against backbone spar 11 than do mast 140 and main beam 120, the relative weakening of upper saddle block 32 by fabricating it in two halves should cause no difficulties in design.

The material used in fabricating mounting means 20 and 30 is preferably the same as used to fabricate backbone spar 11, for a high ratio of strength-to-weight, and to minimize electrolytic corrosion caused by the presence of dissimilar metals in a marine environment. In exception, the material used in fabricating all fasteners is preferably a high-strength corrosion-resistant composition; for example; marine bronze, monel, or stainless steel. Bearing surfaces in mast step assembly 110 may be lubricated by a water-resistant grease, or by the insertion of tubes and washers fabricated of teflon, nylon, or other material having a low coefficient of friction, and resistant to sea water.

It is to be understood that the invention is not limited to the particular mounting means described and depicted herein; many alternative means of mounting may be employed, as for one example: in plural-hull sailing craft wherein backbone spar 11 is to become a permanent part of the hull-interconnecting structure, backbone spar 11 may be riveted or welded directly to beams 120 and 130. Welding can significantly reduce the strength of certain aluminum alloys in the immediate vicinity of the welds; caution must be observed in the design. However, welding will significantly reduce the weight by eliminating mounting means 20 and 30, by replacing them with welds. Alternatively, backbone spar 11 may be bolted directly to beams 120 and 130, employing a spacer between, similar in shape to lower saddle blocks 21 and 31. Care should be taken that the bolts do not cause too high a stress concentration in the skins of beams 120 and 130.

d. Slot Control

Referring to FIG. 1, slot control lines 210 *p* and 210 *s* are attached to forearm 18 near its tip by conventional means (omitted for reasons of clarity) such as by passing a line halfway along its length through a selected hole 15, and knotting said line at each side of web 16, closely thereto, leaving free ends 210*p* and 210*s* secured against running in either direction through hole 15. The free end of slot control line 210*p* is passed through port turning block 211*p* and thence through conventional line cleating device 212*p*. Slot control line 210*s* is similarly led through starboard turning block 211*s* and thence through cleating device 212*s*. When line 210*p* is drawn up taut and secured against moving by cleating device 212*p*, forearm 18 is effectively prevented from bending to starboard under the influence of lateral forces. In like manner, tautening and securing line 210*s* effectively prevents forearm 18 from bending to port. If line 210*p* is slackened a bit and resecured forearm 18 will thus be allowed to bend to starboard, as shown by dashed lines 17, when acted upon by lateral forces coming from port; as for example: lateral forces derived from jib 60 when intercepting wind from the port side as shown. Broken line 67 is a symbolic representation of foot 67 of jib 60 (shown in FIG. 2), when forearm 18 is restrained from bending; dashed line 68 is a symbolic representation of the position of foot 67 when forearm 18 is allowed to deflect to starboard, when line 210*p* is slackened slightly. In the position shown by 68, and with the incident wind coming from port at an acute angle to the line of travel of the craft, as shown, it can be seen that jib 60 will project a larger area between its luff and mast 140 to intercept the wind, thus causing a greater volume of air to flow through slot 80 between jib 60 and mainsail 70 (represented in FIG. 1 by broken line 71). The greater volume of air will cause a higher velocity of airflow in slot 80, improving sail efficiency as is well known in the art. Conversely, if slot control line 210*p* is hauled in far enough to cause forearm 18 to bend a like amount to port, the volume and velocity of air flowing through slot 80 will be less than with forearm 18 undeflected. Thus the operator can control the slot airflow without changing jib sheet tension or the lateral location of the jib sheet trim point. By allowing forearm 18 to bend, the operator can increase slot airflow velocity without a commensurate increase in the danger of backwinding; by comparing the convergences between lines 67 and 68, and 71, it can be seen that the convergences differ only slightly; in contradistinction to the large increase in convergence which would occur if the aft end of line 67 were moved towards mainsail foot 71 by an amount equal to the lateral displacement shown at the luff (fore) ends of lines 67 and 68.

The reduction in width of flanges 13 and 14 towards the fore end of forearm 18 lowers the lateral stiffness to the point where the lateral component of force exerted upon forearm 18 by jib 60 will bend forearm 18 quite far to leeward in strong winds. Consequently, the operator may put line stoppers 213*p* and 213*s* on control lines 210*p* and 210 (conventionally, thick rubber washers backed with a knot) to prevent forearm 18 from bending too far and opening the slot too wide for best efficiency. On large craft, control lines 210*p* and 210*s* may be doubled or tripled back, to form multiple-purchase tackle, so the operators may more easily overcome the lateral force exerted by jib 60. Alternatively, control lines 210*p* and 210*s* may be fabricated of wire cables, and conventional force-multiplying devices used; such as high-ratio levers, high-reduction spool windlasses, and the like. Many other variations on the control of lateral deflection of forearm 18 may be employed, and will be obvious to those skilled in the art; those described and depicted herein will serve to illustrate the principles of the invention.

e. Operation of the Controls.

In light-to-medium winds, the operator may desire to increase the velocity of air flowing through slot 80, to improve sail efficiency and drive force. Consequently, he will secure control lines 210*p* and 210*s* to a predetermined amount of slack on both control lines so as to allow the desired degree of bending of forearm 18 on both tacks, when beating to windward, for example. Once so set, both control lines may be left cleated and require no attention when tacking (unless to compensate for changes in course or the wind); the slack in the control line which is to leeward on each tack will not inhibit control of forearm 18 by that control line which is to windward. In fact, the leeward control line will slacken further as forearm 18 deflects towards it.

In medium wind speeds, when normal slot airflow conditions are desired, both control lines may be hauled taut and cleated off, such that forearm 18 is held straight.

In heavier winds, when it is desirable to reduce heeling forces generated by the sails, by reducing the volume of wind intercepted by jib 60 and thus reducing air velocity in slot 80, the leeward control line must be slackened enough to allow the windward control line to haul the tip of forearm 18 the desired amount to windward, such that forearm 18 is bent to windward. Both control lines must be slackened or tightened on each tack, or the former windward control line will be too short to permit hauling forearm 18 upwind past the neutral unbent position, by the new windward control line. One method for doing this is to cast free the former control line as the craft passes through the wind, so that it can run free up to its line stopper, if required, as the new control line hauls forearm 18 to the desired degree of upwind bend.

During very heavy winds, just prior to reefing for example, the operator may desire to open the slot to a maximum by allowing the windward control line to run out against its line stopper, while setting the jib sheet laterally outwards so that much of the airflow along jib 60 escapes without attaching itself to the leeside of mainsail 70: this flow of air remote from the leeside of mainsail 70 greatly reduces slot 80's enhancement of sail efficiency.

DESCRIPTION OF FIRST VARIATION OF THE PREFERRED EMBODIMENT

To cause the main sheet tensile forces to be exerted more directly upon backbone 11, the lower sheet block(s) may be mounted directly upon upper saddle block 32. This limits mainsail trimming to a center-sheeting arrangement, but many existing sailing craft use nothing but a centersheeting arrangement, obtaining greater sheeting angles by slacking the sheet and employing vang tackle near the forward end of the boom to keep the boom from rising. If, under this arrangement sheet track 131 were to be eliminated, upper saddle block 32 could be made in one piece, in like manner to upper saddle block 22.

If backbone spar 11 were extended aft of aft mounting means 30 in the like manner to the extension of forearm 18, the sheet trim point could be relocated slightly aft of the mainsail clew's vertical projection downward to the aft extension of backbone spar 11. In this manner the main boom may be eliminated, removing the annoyance and danger to the operators attendant upon the violent swinging of the main boom from one side to the other as the craft tacks. The mainsail would therefore be loose-footed, and would be controlled in the same manner as such other loose footed sails; for example: staysails, jibs, genoas, etc.

Causing the aft arm to bend to leeward, in like manner to the bending of forearm 18, will allow a departure from center-sheeting; the sheet trim point will have a sheeting angle greater than zero on both tacks, and will pull down more directly on the mainsail, since vangs are impractical on loose-footed sails. The greater the length of the aft extension, and the lower its lateral stiffness, the greater will be the sheeting angle of the sheet trim point. Control of this lateral bending may be accomplished in a manner similar to control of the lateral bending of forearm 18.

As a result of the elimination of the main boom and the aft extension of backbone 11, the mainsail foot may be brought down in close proximity to the deck or trampoline of the sailing craft. The advantages of so-called decksweeper sails are well-known, and include better aerodynamic efficiency and a smaller heeling moment. The operators may pass under the foot of such a decksweeper mainsail by easing the sheet and lifting the foot manually, to change sides when tacking.

Figure 6:
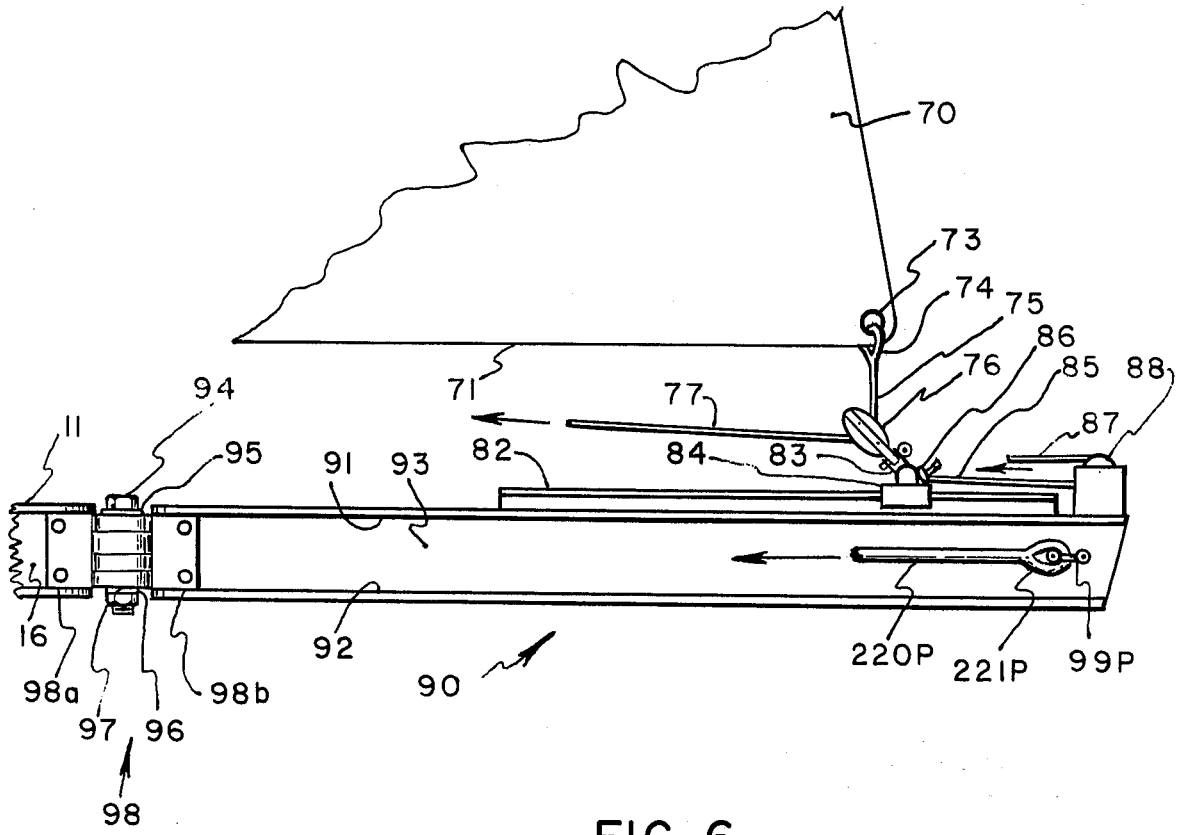
FIG. 6 is a port side elevation view of the first variation of the preferred embodiment, showing the aft extension of the backbone spar, joined to the backbone spar by a vertical axis hinge, and showing the mainsail clew and sheet track and traveller.

In a loose-footed mainsail it is advantageous to extend the sheeting base laterally at least to a value which would allow for a sheeting angle of about 8° to 10°; a common sheeting angle for fast sailing craft with efficient sails. In this manner the sheet pull will be more directly downward, causing better control of mainsail shape. In sailing craft whose length of mainsail foot is too short to allow for an aft extension to bend safely to that sheeting angle, this may be accomplished by pivotally connecting the aft arm to the aft end of backbone spar 11, in the vicinity of aft mounting means 30, for example. This is illustrated in FIG. 6, a fragmentary side view of aft arm 90, hinge 98, and the after end of backbone spar 11, and mainsail 70. Aft arm 90 comprises a length of I-beam identical in material and cross-section shape to that used in fabricating backbone 11, hinge assembly 98 joins the forward end of aft arm 90 to the aft end of backbone spar 11, hinge half **98*a* being fastened by conventional means to web 16 of the backbone 11, hinge half 98*b* being fastened in like manner to web 93 of aft arm 90. Hinge pin 94, herein depicted as a bolt, is passed through corresponding holes in hinge halves 98*a* and 98*b* and is secured in place by nut 97, customary washers 95 and 96 being employed. To allow for rotation of aft arm 90 in the horizontal, the adjacent ends of flanges 13 and 91, and 14 and 92 are rounded or beveled off such that they do not interfere with each other. Thus aft arm 90 is pivotally mounted to backbone spar 11 in such manner that vertical forces are resisted but lateral forces cause aft arm 90** to deflect horizontally in response.

Control lines **220*p*, shown partially, and 220*s*, not shown, control rotation of aft arm 90 in like manner to the control of lateral deflection of forearm 18. Control line 220*p* is attached to the aft end of aft arm 90 by forming one end into eye 221*p* around eyestrap 99*p*, control line 220*s* is attached in like manner, by forming eye 221*s* aroun eyestrap 99*s*. The free end of control line 220*p* is then led forward, as indicated by the arrow, to port side beam 170 in similar manner to control line 210*p*; control line 220*s* is led to starboard side beam 180 in similar manner to control line 210*s***.

Main sheet cable 75 is formed into an eye 74 passing through clew grommet 73 of mainsail 70, by splicing or crimping compression sleeves. Main sheet cable 75 is then passed through sheet block 76, its free end 77 is then led forward, as indicated by the arrow, to conventional sheet hauling and securing means not shown. Sheet block 76 is attached by captive shackle 83 to traveller car 84, which is slidably mounted on sheet track 82. Track 82 is mounted on the upper surface of flange 91 by conventional fasteners not shown. Traveller car 84 is outhauled towards the aft end of aft arm 90 by outhaul line 85 when it is desired to to reduce sail curvature in conventional manner; outhaul line 85 being tied to captive shackle 83 by knot 86 and thence passing through turning block 88, and its pendant end 87 being led forward, as indicated by the arrow, to a location convenient to the operators and there secured by conventional cleating means not shown.

In operation, the sheeting angle of mainsail 70 is controlled by whichever control line **220*p* or 220*s* is to windward; hauling on the windward control line reduces the sheeting angle, slackening the control line allows the lateral forces on mainsail 70 to rotate aft arm 90 more to leeward thus increasing the sheeting angle. When tacking, aft arm 90 may be hauled manually over to the other tack by slackening the former windward control line and tightening the new windward control line. If the proper amount of slack is set in both control lines 220***p* and 220*s* to permit the desired sheeting angle to be attained on both tacks, the reversal of wind forces on mainsail 70 which occur when the craft tacks or gybes will cause mainsail 70 to swing over to the new tack, carrying aft arm 90 along. It can be seen that in this mode of operation mainsail 70 is self-tending, requiring no attention from the operators other than the usual minor adjustments to compensate for slight changes in wind or course, and unless sheet and outhaul tension are so high as to cause an inability to accomodate for the momentary increase in length from the mast (mainsail tack) to traveller car 84 (or mainsail clew) which occurs as aft arm 90 becomes aligned with the longitudinal axis of backbone spar 11.

DESCRIPTION OF SECOND VARIATION OF THE PREFERRED EMBODIMENT

Certain plural-hull sailing craft, such as proas, calies, and other forms of single-ourigger craft, lack the bilateral symmetry of catamarans and trimarans. The proa, which comprises a shorter, double-ended hull kept to windward when tacking by reversing the direction of travel, and a longer, double-ended hull kept to leeward; both hulls held in fixed spatial relationship with each other, has only fore-and-aft symmetry. When the proa tacks by going into reverse, the sails and steering means must also be reversed, and usually must be moved to the opposite end of the craft at each tack. The principles of my invention may easily be applied to such craft by so fabricating and mounting backbone spar 11 that it possesses two projecting arms, one at each end; each arm provided with attaching means for forestays and headsails, and for main sheets should center-sheeting be used. Control means are provided for each arm, to control lateral deflection of the headsail luff and mainsail sheeting angle, as the case may be.

In operation, when reversing to tack, attached stays, tack downhauls, and sheets are moved to the opposite arm of backbone 11, and re-attached there to the appropriate attaching means. The controls are then readjusted for the desired sail settings and the craft clears away on the new tack. Movable attaching means may be used, as in the preferred embodiment, and the forearms may either be hinged or possess a flow magnitude of lateral stiffness.

DESCRIPTION OF THIRD VARIATION OF THE PREFERRED EMBODIMENT

A type of multihull sailing craft also of my invention, described fully in U.S. Pat. No. 3,933,110 and in my co-pending divisional application Ser. No. 825,441, lacks any symmetry, except for a transitory moment when tacking. Application of the principles of this invention to such a craft are illustrated in top plan view in FIG. 7; the third variation of the preferred embodiment being indicated generally at 10.

A preferred embodiment of the plural-hull sailing craft of U.S. Pat. No. 3,933,110 and co-pending application Ser. No. 612,630 comprises, briefly: port hull 350, starboard hull 360, aft hull 370, held in mutually-spaced relationship by Y-shaped hull-interconnecting spyders 320 and 330. Main spyder 320 comprises: port leg 322, starboard leg 323, aft leg 324, and hub 321; legs 322, 323, and 324 being welded to strong, vertical right-cylindrical hub 321. Aft spyder 330 is mounted generally slightly higher in elevation than main spyder 320 for clearance, and comprises: port leg 332, starboard leg 333, aft leg 334, and hub 331; legs 332, 333, and 334 being joined to strong, vertical right-cylindrical hub 331 by welding. Pairs of vertical tubes, mechanically connected to and projecting vertically upwards from hulls 350, 360, and 370, are housed pivotally in the ends of legs 322, 323, 324, 332, 333, and 334; the ends of the six vertical tubes and associated pivot means being symbolically represented by circles 340 for reasons of clarity. Port foot rail 351, a smaller and lighter form of side beam, extends between the outer ends of legs 322 and 332, being pivotally mounted on top of leg 322 and below leg 332 such that it is essentially horizontal. Starboard foot rail 361 is mounted in like manner to legs 323 and 333. Foot rails 351 and 361 support the outer edges of decking netting, ommitted for clarity, which support the crew, and further serve as foot supports for crew members hanging overside in trapeze harness. Because of the employment of the principles of this invention foot rails 351 and 361 have no other structural function, and hence may weigh substantially less than structural side beams. Since the crew is usually stationed on the windward side of the deck netting near the windward hull (hull 350 in the port tack configuration shown in FIG. 7; hull 360 in the mirror-image starboard tack configuration) no foot rail or deck netting is needed between aft legs 324 and 334.

Figure 7:
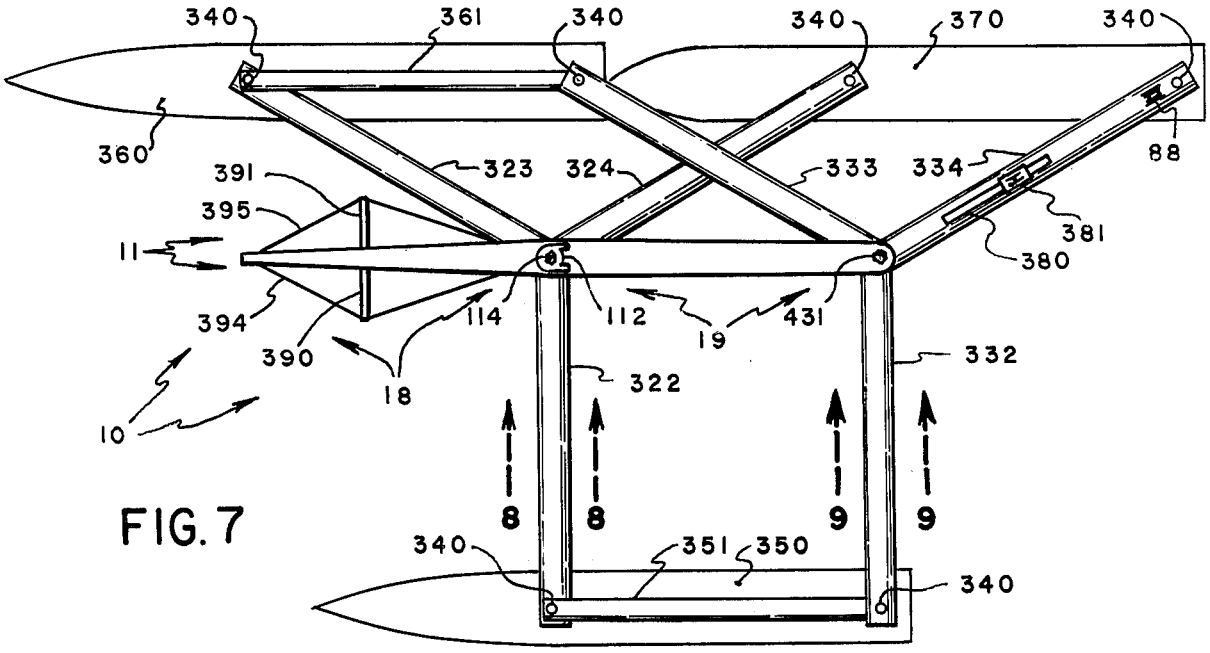
FIG. 7 is a top plan view of the third variation of the preferred embodiment, mounted on a plural-hull sailing craft which undergoes a mirror-image transformation.

In operation of the craft, when tacking or gybing through the wind, it is desirable to end up on the opposite tack with one forehull to windward, for considerations of stability. FIG. 7 shows the port tack configuration, with port hull 350 being alone and to windward and aft hull 370 being longitudinally aligned with and closely following starboard hull 360. On the starboard tack, starboard hull 360 would be alone and to windward, with port hull 350 longitudinally aligned closely ahead of aft hull 370. The change from one configuration to its mirror-image is accomplished by rotating all hulls counterclockwise from the port tack configuration of FIG. 7, until hulls 350 and 370 are longitudinally aligned; changing from the starboard tack configuration to the port tack configuration is accomplished by rotating all hulls through an equal angle clockwise. Hulls 350, 360, and 370 are constrained to rotate simultaneously in parallel through equal angles by spyders 320 and 330; the whole acting as a multiple parallelogram linkage.

It is to be understood that the above brief description is not complete, being simplified herein for brevity, and being described and depicted herein for exemplary purposes; U.S. Pat. No. 3,933,110 and co-pending application Ser. No. 612,630 should be examined for full disclosure.

Referring to FIG. 7, third variation of the preferred embodiment 10 comprises: Backbone spar 11, of material, general design and fabrication has heretofore described, main mounting means 420, aft mounting means 430, mast step assembly 110, port spreader 390, starboard spreader 391, port stay 394, starboard stay 395, and the various forestay, jib tack, and main sheet attaching means, and controls previously described.

Backbone spar 11 is illustrated as having full width flanges 13 and 14 in beam 19 section between hubs 321 and 331. This is a desirable feature to increase lateral and torsional stiffness, to better resist moments caused by the pull of the main sheet being offset laterally from the longitudinal axis of backbone spar 11, and in the absence of side beams. The additional weight of having full width flanges is offset by the weight saving resulting from replacing light foot rails for heavy side beams.

Forearm 18 is shown being stiffened laterally by a conventional diamond-stay system, such as that often used to laterally stiffen masts, and comprising: spreaders 390 and 391, fabricated of light hollow tubing, and diamond stays 394 and 395, preferably fabricated of flexible cable. The terminating, fastening, and tensioning devices commonly employed in the diamond-stay system are very well known to those skilled in the art, and are omitted here for purposes of clarity and brevity. Other conventional stiffening and/or staying systems may be employed with the desired results, as for example: leaving flanges 13 and 14 full width for the complete length of forearm 18.

Alternatively, slot airflow control means may be employed, as in the preferred embodiment heretofore described, observing one caution: since backbone spar 11 is pivotally mounted upon spyders 320 and 330, control lines must be routed close to the axis of spyder 320 before being routed to cleating means mounted on spyder 320, for example. If such control lines were routed directly from backbone spar 11 to locations on legs 322 and 323, for example, they could inhibit rotation of the hulls, or be broken, or cause damage to forearm 18. Alternatively, control lines may be cleated directly to cleating devices mounted upon backbone spar 11.

Figure 8:
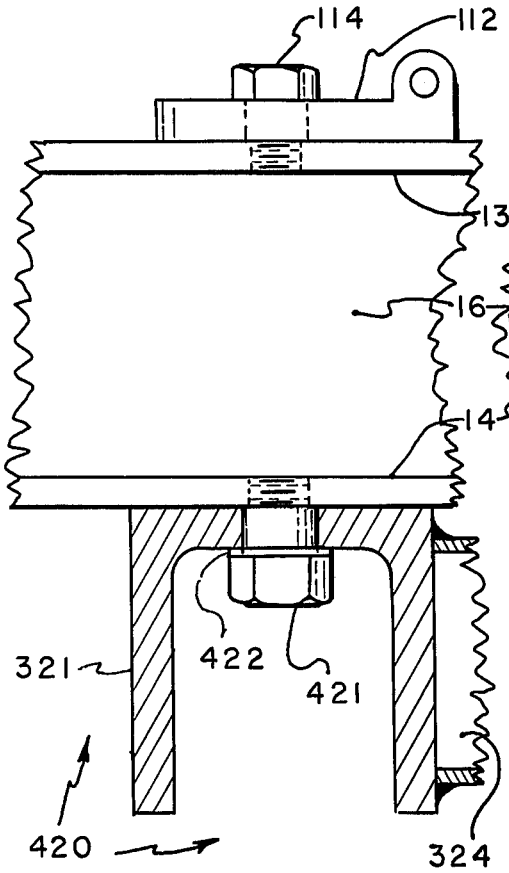
FIG. 8 is a detailed fragmentary port side view of the main mounting means of the third variation, showing the mast step, and the central hub of the main spyder in section.

FIG. 8 is a fragmentary port side elevation view of main mounting means 420, showing mast step assembly lower hinge half 112, and showing main hub 321 and the root of leg 324 in section. Main mounting means 420 comprises shouldered screw 421 threaded into a threaded hole in lower flange 14, pivotally mounting backbone spar 11 to main hub 321 along the vertical axis of spyder 320, and washer 422. The shoulder of screw 421 is of sufficient length to prevent binding against hub 321, and acts as a radial bearing surface. The top surface of hub 321 bears against the bottom surface of flange 14, acting as a thrust bearing. The bearing surfaces may be lubricated with a water-resistant grease, or a nylon or teflon washer.

Lower mast step hinge half 112 is shown mounted upon upper flange 13, and retained in place by shouldered screw 114, which is screwed into a threaded hole in upper flange 13. In all other particulars mast step assembly 110 is as heretofore described and depicted. Mast downthrust forces and backbone spar 11 reaction forces are transmitted between backbone spar 11 and the mast through lower hinge half 112 directly.

Figure 9:
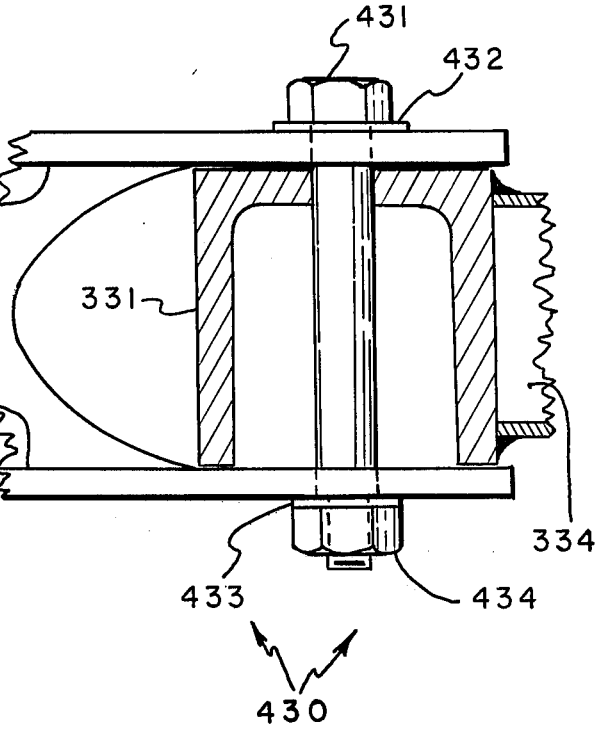
FIG. 9 is a detailed fragmentary port side view of the aft mounting means of the third variation, showing the central hub of the aft spyder in section.

FIG. 9 is a detailed fragmentary port side view of aft mounting means 430, showing aft hub 331 and aft leg 334 in section. Aft mounting means 430 comprises extended shouldered bolt 431, passing through upper and lower flanges 13 and 14 of backbone spar 1 and aft hub 331 along the central axis of spyder 330; washers 432 and 433 being employed to enlarge the bearing surfaces under the head of screw 431 and nut 434, the tightening of nut 434 bringing the shoulder of screw 431 into contact with washer 433, the length of the shoulder being such as to prevent clamping of flanges 13 and 14 against hub 331 and resulting binding and high friction. Web 16 of backbone spar 11 is cut away to clear the roots of legs 332 and 333 as they rotate relatively to backbone spar 11, into either tack configuration. The lower surface of flange 13 and the upper surface of flange 14 bear against the ends of hub 331 in the manner of thrust bearings. The shoulder of screw 431 acts as a radial bearing. As before, the bearings may be lubricated with grease, or by the insertion of flat and tubular shims fabricated of self-lubricated materials.

Referring again to FIG. 7, aft leg 334 of aft spyder 330 carries sheet track 380 securely affixed to its upper surface. Main sheet traveller 381 is slidably mounted on sheet track 380; sheet traveller 381 carrying a sheet block similar to block 76, and connected to an outhaul line, omitted for reasons of clarity. Sheet tensioning and outhauling means are employed and mounted in like manner to those of first variation of the preferred embodiment; the same being well known to those skilled in the art and needing no detailed description herein. The outer end of aft leg 334 offers a suitable mounting location for outhaul turning block 88. Outhaul lines and sheet lines are subject to the same caution on routing close to hub 331 that slot control lines on the forearm are. Aft leg 334, inclining to leeward 30 degrees from the longitudinal axis of backbone 11 and the line of travel of the craft, offers a desirable location for sheet track 380, in like manner to aft arm 90 previously described; providing a sheeting angle which may be in the vicinity of 8° to 10°, depending upon spyder separation. Thus the mainsail may be loose-footed, and be used as a deck-sweeper. It can be seen that aft leg 334 inherently possesses some desirable features of aft arm 90, save that its angular rotation is not variable nor controllable for purposes of sheeting angle control. However, use of aft leg 334 to mount sheet track 380 causes a further saving in weight by eliminating aft arm 90 and its controls.

Operation of this invention, as applied to the plural-hull sailing craft of U.S. Pat. No. 3,933,110 and co-pending application Ser. No. 612,630, is identical to that previously described, except for the action of aft leg 334. As the hulls rotate to transform the configuration of the craft to its mirror-image, aft leg 334 will rotate with respect to the longitudinal axis of backbone spar 11 by the action of rotating the hulls, clockwise when transforming from the port tack configuration to the starboard tack configuration for example, becoming momentarily aligned with the longitudinal axis of backbone spar 11 halfway through the rotation, then finally coming to rest 30 degrees to the opposite side of the longitudinal axis of backbone spar 11. This rotation of aft leg 334 with respect to backbone spar 11 causes sheet track 380 and traveller 381 to be automatically carried to the mirror-image locations on the opposite tack, and to the identical sheeting angle on the other tack. Thus, if the sheet and outhaul lines have enough slack to allow for longer distance between the mast and traveller 381 at the moment of mutual alignment between aft leg 334 and backbone spar 11, the mainsail sheet trim point will forcibly and automatically be carried over to the new tack; unlike the operation of aft arm 90, not being dependant on wind force reversal so to do.

In summary, one preferred embodiment of the invention, applied to three distinct types of plural-hull sailing craft, in three variations thereof, has been described. It has been emphasized throughout that the preferred embodiment, and the variations thereof, are merely illustrative of the many ways in which an improved rigging base may be provided for stays, headsails, mainsails, and mizzensails, which reduce the forces to which hulls and hull-interconnecting structures are subjected, and make possible significant savings in weight and improve sail control, performance, and ease in handling plural-hull sailing craft.

Although the preferred embodiment and its variations have been described for application to plural-hull sailing craft other than trimarans, and other forms of double-outrigger craft, the scope of the invention includes use on such trimarans. Although trimarans possess a convenient and conventional location for attaching rigging, application of the principles of the invention may be used to reduce mast downthrust loading upon the central main hull, or hull-interconnecting rigging, as the case may be. Further, the invention may be used on trimarans to provide slot control, improved sail efficiency and ease of handling.

And further, although the preferred embodiment and its variations are exemplary of a rigging base system for craft sailing upon water, the scope of my invention includes other types of sailing craft, such as iceboats, sad sailers, and other sailing craft having a plurality of runners, wheels, or other load-supporting elements situated to either side of the rigging base location of the craft and not below, and which may benefit from employment of the invention.

Although I have described and illustrated my invention in detail, it is to be understood that the same is by way of illustration and example only, and is not to be taken by way of limitation, the spirit and scope of the invention being limited only by the terms of the claims appended below.

I claim:

1. An improved rigging-base system for a plural-hull sailing craft, comprising:

(a) elongated spar means adapted for attachment of rigging, and further adapted for being mounted longitudinally on a plural-hull sailing craft with at least one arm of said spar means projecting outward beyond any structure of said craft upon which said spar means is mounted, said arm being capable of substantial controllable lateral deflection at its outer end, (b) attaching means, whereby standing and running rigging may be attached to said spar means, (c) a plurality of mounting means for mounting said spar means on said plural-hull sailing craft, first said mounting means being adapted for mechanically connecting said spar means to first hull-interconnecting structure of said sailing craft, second said mounting means being adapted for mechanically connecting said spar means to second hull-interconnecting structure of said sailing craft, (d) mast step means for mounting the foot of the mast of said sailing craft whereby downthrust forces exerted by said mast may be transmitted to said spar means, whereby reaction forces exerted by said spar means responsive to upward components of tension in said rigging attached to said spar means will oppose a substantial portion of said downthrust forces, thereby reducing the forces to be resisted by said hull-interconnecting structures and hulls of said sailing craft, and further whereby the weight of said hulls and said hull-interconnecting structures may be reduced.

2. The improved rigging-base system of claim 1 wherein said arm acts as a cantilevered beam having a high magnitude of vertical stiffness to resist vertical forces, said arm hereinafter designated after the direction said arm projects, taken with respect to the line of travel of said sailing craft, as for example: an outwardly forward-projecting arm would be designated as the forearm, an outwardly rearward-projecting arm would be designated as the aft arm.

3. The improved rigging-bases system of claim 2, including:

(a) a forearm having a low magnitude of lateral stiffness, whereby said forearm is caused to bend laterally, responsive to lateral forces exerted upon said forearm, first said lateral forces being exerted by at least one headsail connected to said forearm by headsail tack attaching means, whereby said forearm may be caused to bend to leeward, second said lateral forces being exerted by control means connected to said forearm, whereby said forearm may be caused to bend to leeward, or to windward, or to remain straight, (b) control means for controlling the magnitude and direction of lateral bending of said forearm, said control means being capable of overcoming first said lateral forces when it is desired to bend said forearm to windward, whereby said forearm may be prevented from bending even when first said lateral forces are being exerted upon said forearm, whereby said forearm may be caused to bend to leeward to cause the luff of said headsail to be displaced to leeward, thereby increasing the flow of air directed by said headsail along the leeside of a mainsail, thus increasing sail efficiency, whereby said forearm may be caused to bend to windward so as to cause said luff of said headsail to be displaced to windward, thereby decreasing said flow of air along said leeside of said mainsail, thus causing a decrease in said sail efficiency, and whereby said control means may be preset to limit said bend to leeward to those magnitudes desired on both tacks, thereby allowing the reversal of first said lateral forces, occuring when the wind strikes the opposite side of said headsail as said sailing craft tacks, to reverse said bend, such that said headsail luff is selftending.

4. The improved rigging-base system of claim 3 wherein said headsail tack attaching means includes moveable positioning means whereby the location of said headsail tack attaching means may be moved longitudinally along said forearm, wherein said mounting means include clamping means, whereby said spar means may be clamped to said first and second mounting means, and whereby said first and second mounting means may be clamped to main and aft said hull-interconnecting structures, said first mounting means being clamped to said main hull-interconnecting structure, said first mounting means being adapted to mount said mast step means, said second mounting means being clamped to said aft hull-interconnecting structure, said second mounting means being adapted to provide clearance for sheet track means mounted upon said second hull-interconnecting structure, whereby an uninterrupted passage is provided for sheet traveller means slidably mounted upon said sheet track means.

5. The improved rigging-base system of claim 2, including:

(a) an aft arm having a low magnitude of lateral stiffness, whereby said aft arm is caused to bend laterally, responsive to lateral forces exerted upon said aft arm, first said lateral forces being exerted by at least one mainsail or mizzensail connected to said aft arm by sheet attaching means, whereby said aft arm may be caused to bend to leeward, second said lateral forces being exerted by control means connected to said aft arm, whereby said aft arm may be caused to bend to leeward, or to windward, or to remain straight, (b) control means for controlling the magnitude and direction of lateral bending of said aft arm, said control means being capable of overcoming first said lateral forces when it is desired to bend said aft arm to windward, whereby said aft arm may be prevented from bending even when first said lateral forces are being exerted upon said aft arm, thereby setting a zero magnitude of sheeting angle, whereby said aft arm may be caused to bend to leeward to set a desired positive magnitude of sheeting angle, whereby said aft arm may be caused to bend to windward when it is desired to set a negative magnitude of sheeting angle, and whereby said control means may be preset to limit said bend to leeward to those magnitudes of said sheeting angles desired on both tacks, thereby allowing the reversal of first said lateral forces, occuring when the wind strikes the opposite side of said mainsail or mizzensail as said sailing craft tacks, to reverse said bend, such that said mainsail or mizzensail is self-tending.

6. The improved rigging-base system of claim 2, including:

(a) a forearm fabricated as a separate entity, being a pivotally-connected extension of said spar means, (b) vertical-axis hinge means for pivotally connecting the inboard end of said forearm to the fore end of said spar means, whereby vertical components of forces may be transmitted between said forearm and said spar means, and whereby said forearm is caused to rotate in a horizontal plane responsive to lateral forces exerted upon said forearm, first said lateral forces being exerted by at least one headsail connected to said forearm by headsail tack attaching means, whereby said forearm may be caused to rotate to leeward, second said lateral forces being exerted by control means connected to said forearm, whereby said forearm may be caused to rotate to leeward, or to windward, or to remain straight, (c) control means for controlling the magnitude and direction of lateral rotation of said forearm, said control means being capable of overcoming first said lateral forces when it is desired to rotate said forearm to windward, whereby said forearm may be prevented from rotating even when first said lateral forces are being exerted upon said forearm, whereby said forearm may be caused to rotate to leeward to cause the luff of said headsail to be displaced to leeward, thereby increasing the flow of air directed by said headsail along the leeside of a mainsail, thus increasing sail efficiency, whereby said forearm may be caused to rotate to windward so as to cause said luff of said headsail to be displaced to windward, thereby decreasing said flow of air along said leeside of said mainsail, thus causing a decrease in said sail efficiency, and whereby said control means may be preset to limit said rotation to leeward to those magnitudes desired on both tacks, thereby allowing the reversal of first said lateral forces, occuring when the wind strikes the opposite side of said headsail as said sailing craft tacks, to reverse said rotation, such that said headsail luff is self-tending.

7. The improved rigging-base system of claim 2, including:

(a) an aft arm fabricated as a separate entity, being a pivotally-connected extension of said spar means, (b) vertical-axis hinge means for pivotally connecting the inboard end of said aft arm to the aft end of said spar means, whereby vertical components of forces may be transmitted between said aft arm and said spar means, and whereby said aft arm is caused to rotate in a horizontal plane responsive to lateral forces exerted upon said aft arm, first said lateral forces being exerted by at least one mainsail or mizzensail connected to said aft arm by sheet attaching means, whereby said aft arm may be caused to rotate to leeward, second said lateral forces being exerted by control means connected to said aft arm, whereby said aft arm may be caused to rotate to leeward, or to windward, or to remain straight, (c) control means for controlling the magnitude and direction of lateral rotation of said aft arm, said control means being capable of overcoming first said lateral forces when it is desired to rotate said aft arm to windward, whereby said aft arm may be prevented from rotating even when first said lateral forces are being exerted upon said aft arm, thereby setting a zero magnitude of sheeting angle, whereby said aft arm may be caused to rotate to leeward to set a desired positive magnitude of sheeting angle, whereby said aft arm may be caused to rotate to windward when it is desired to set a negative magnitude of sheeting angle, and whereby said control means may be preset to limit said rotation to leeward to those magnitudes of said sheeting angles desired on both tacks, thereby allowing the reversal of first said lateral forces, occuring when the wind strikes the opposite side of said mainsail or mizzensail as said sailing craft tacks, to reverse said rotation, such that said mainsail or mizzensail is self-tending.

8. The improved rigging-base system of claim 2 wherein said plural-hull sailing craft is a proa, or other craft which reverses direction of travel when tacking or gybing, whereby the fore end of said craft becomes the aft end, and vice-versa, and wherein the sails are rotated in the horizontal approximately 180 degrees when said craft reverses said direction of travel, therby requiring two identical sets of said attaching means disposed in opposite directions, said improved rigging-base system including:

(a) identical said arms extending both ends of said spar means, both said arms being adapted for attaching said standing and running rigging in both said directions of travel, (b) first and second said sets of said attaching means transposed end for end along said arms and said spar means, first said set of said attaching means being arranged for attaching said sails and said standing and running rigging to said arms and said spar means for first direction of travel, second said set of said attaching means being arranged for attaching said sails and said standing and running rigging to said arms and said spar means for second direction of travel, whereby said sails and said rigging may be attached and controlled in both said directions of travel of said sailing craft.

9. The improved rigging-base system of claim 2 wherein the hulls of said plural-hull sailing craft rotate simultaneously in the horizontal such that the mutual spatial configuration of said hulls undergoes a mirror-image transformation wherein an aft said hull is caused to become longitudinally aligned in close proximity astern of either a port said hull or a starboard said hull, said aft hull being aligned with said starboard hull on the port tack, it being understood that the direction of travel of said sailing craft undergoes an angular displacement equal to the angle of rotation of said hulls, whereby it is desireable that the centerline of the mounting base for said standing and running rigging also be rotated through said angle of rotation of said hulls, also wherein said sailing craft possesses a member, herein called the sheet leg, extending generally aft from the center of rotation of the aftmost said hull-interconnecting structure, the longitudinal centerline of said sheet leg forming an acute angle to starboard with said longitudinal axis of said spar means when said sailing craft is in the port tack configuration, said centerline of said sheet leg forming identical said acute angle with said longitudinal axis of said spar means to port when said sailing craft is in the starboard tack configuration, said sheet leg being rotated from one side to the other incidental to and resulting from rotation of said hulls, said rigging-base system including:

(a) a forearm adapted to mount said headsail tack attaching means, (b) said mounting means include pivotal means whereby the angular relationships in the horizontal between said spar means and said hull-interconnecting means may be allowed to vary, first said mounting means being pivotally connected to the central hub of main said hull-interconnecting structure, second said mounting means being pivotally connected to the central hub of aft said hull-interconnecting structure, whereby forces may be transmitted between said spar means and said main and aft hull-interconnecting structures, whereby said spar means is constrained to lie along the instantaneous said direction of travel, it being understood that said spar means, said hulls, and said hull-interconnecting means stand in relation to each other as members of multiple parallelogram linkages, whereby said centerline of said mounting base for said standing and running rigging is constrained to be rotated through said angle of rotation of said hulls, simultaneously with said rotation of said hulls and as a result of said rotation of said hulls, (c) said attaching means includes said headsail tack attaching means mounted on said forearm, and main sheet attaching means mounted on said sheet leg, said attaching means including moveable positioning means whereby the location of said attaching means may be varied generally longitudinally, and (d) said mast step means being mounted on said spar means, whereby rotation of said hulls causes automatic tending of said headsail and said mainsail when said craft tacks or gybes, said headsail being automatically tacked as said longitudinal axis of said spar means passes across the direction of the true wind, said mainsail being automatically tacked as said centerline of said sheet leg passes across said direction of the true wind.

10. The improved rigging-base system of claim 1 wherein said mounting means includes detachable clamp means for clamping said spar means to said mounting means, or for clamping said hull-interconnecting structure to said mounting means, or for clamping both said spar means and said hull-interconnecting structure to said mounting means, or for clamping said spar means to said hull-interconnecting structure, whereby said spar means may be mounted upon an existing said plural-hull sailing craft, or removed therefrom.

11. The improved rigging-base system of claim 1 wherein said mounting means includes pivotal means whereby the angular relationships in the horizontal between said spar means and said hull-interconnecting structures may be allowed to vary.

12. The improved rigging-base system of claim 1 wherein said attaching means includes at least one moveable positioning means whereby the location of said attaching means may be varied generally longitudinally.

13. A method for sail control in plural-hull sailing craft having an jib and mainsail, comprising the following:

(a) providing an elongated backbone spar having a forward end adapted to attach to the tack of said jib, said spar being adapted for being mounted on the hull-interconnecting structure of said sailing craft, said forward end of said spar capable of significant lateral deflection whereby horizontal forces exerted on said forward end of said spar by said jib tack and by control means cause said forward end of said spar to deflect in the horizontal, (b) mounting said spar horizontally longitudinally on said hull-interconnecting structure such that said forward end projects forward to the proper location for attaching said jib tack, (c) attaching said jib tack to said forward end of said spar, (d) providing control means for controlling the lateral displacement of the jib luff by controlling the horizontal deflection of the forward end of said spar, (e) connecting said control means to said spar, (f) in light winds, setting said control means such that said jib luff is allowed to deflect to leeward, thereby increasing the volume of incident airflow intercepted by said jib and redirected through the slot between said jib and said mainsail, thus increasing sail efficiency and drive force, (g) in medium winds, setting said control means such that said jib luff remains undeflected, whereby normal said sail efficiency is attained, (h) in moderately heavy winds, setting said control means such that said jib luff is caused to deflect to windward, thereby decreasing said volume of incident airflow intercepted by said jib and redirected through said slot between said jib and said mainsail, thus decreasing said sail efficiency and reducing heeling forces, (i) in heavy winds, setting said control means such that said jib luff is caused to deflect a substantial amount to leeward, and setting the jib sheet trim point at least a like amount to leeward, thereby allowing a substantial portion of said volume of airflow through said slot to pass through said slot without passing in close proximity to the lee side of said mainsail, whereby slot enhancement of said sail efficiency is substantially reduced, further reducing said heeling forces, (j) when beating to windward in light to medium winds, presetting said control means to cause said jib luff to attain the desired values of deflection to leeward on both tacks, automatically and without further attention each time the said sailing craft tacks.

14. A method for sail control in plural-hull sailing craft wherein the hulls of said sailing craft rotate in the horizontal to cause a mirror-image transformation in mutual spatial relationship between said hulls, in which it is desireable to cause the sails and rigging of said craft to undergo a like mirror-image transformation, said method comprising the following:

(a) providing an elongated backbone spar having a forward end adapted to attach to a jib luff, (b) pivotally mounting said spar on the centers of rotation of the hull-interconnecting spyders of said craft such that said forward end projects forward to the proper location for attaching said jib tack, said mounting pivotally connecting said spar to said hull-interconnecting spyders whereby said spar acts as a member of a multiple-linkage parallelogram system, whereby said spar is constrained to rotate simultaneously and in parallel through equal angles with said hulls, (c) attaching said jib tack to said forward end of said spar whereby the location of said jib tack, taken with respect to the line of travel of said sailing craft, is caused to undergo a like mirror-image transformation simultaneously with said mirror-image transformation of said sailing craft, (d) mounting longitudinally-moveable main sheet trim point attaching means on the aft leg of aft said hull-interconnecting spyder, located below and slightly aft of the desired location of the mainsail clew, whereby said main sheet trim point may be outhauled to reduce mainsail camber, whereby said mainsail may be controlled without a boom, thereby saving weight and reducing danger and annoyance to the crew, whereby said mainsail may be set in close proximity to the deck or trampoline of said sailing craft, thereby increasing the efficiency of said mainsail and reducing the heeling moment thereof, whereby rotation of said aft leg of said aft spyder, taken with respect to the longitudinal axis of said spar, causes a mirror-image transformation in the location of said main sheet trim point, said transformation being incidental to said rotation of said hulls, occuring automatically and without attention by the operators of said sailing craft or dependence upon the reversal of the incidence of the wind upon said mainsail.

* * * * *

UNITED STATES PATENT AND TRADEMARK OFFICE

CERTIFICATE OF CORRECTION

PATENT NO. : 4,108,100

DATED : August 22, 1978

INVENTOR(S) : Robert Stuart Jamieson

It is certified that error appears in the above-identified patent and that said Letters Patent are hereby corrected as shown below:

Column 4, line 43, change "and" to --the--.
line 57, after "volume" insert --of--.

Column 7, line 3, change "mains" to --main--.
line 37, change "pound" to --pounds--.

Column 8, line 12, change "eigher" to --either--.

Column 9, line 49, change "high by" to --by high--.

Column 10, line 14, before "114" insert --of screw--.

Column 12, line 36, change "210" to --210s--.

Column 14, line 44, change "aroun" to --around--.

Column 15, line 52, change "flow" to --low--.

Column 17, line 61, change "l" to --ll--.

Column 19, line 22, change "sad" to --sand--.

Column 20, line 19, start a separate subparagraph at "second said".
line 31, start a separate subparagraph at "whereby said forearm".
line 42, start a separate subparagraph at "whereby said control".

UNITED STATES PATENT AND TRADEMARK OFFICE

CERTIFICATE OF CORRECTION

PATENT NO. : 4,108,100

DATED : August 22, 1978

INVENTOR(S) : Robert Stuart Jamieson

It is certified that error appears in the above-identified patent and that said Letters Patent are hereby corrected as shown below:

Column 21, line 13, start a separate subparagraph at "second said lateral".
line 26, start a separate subparagraph at "whereby said aft".
line 54, start a separate subparagraph at "second said lateral".
line 66, start a separate subparagraph at "whereby said forearm".

Column 22, line 50, start a separate subparagraph at "whereby said control".
line 65, change "therby" to --thereby--.

Column 23, line 55, start a separate subparagraph at "second said mounting means".

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*